United States Patent [19]

Chudner

[11] 3,948,195

[45] Apr. 6, 1976

[54] SHEET-MATERIAL FEEDING UNIT

[76] Inventor: Joseph Chudner, 2907 Brighton 8th St., Brooklyn, N.Y. 11235

[22] Filed: Mar. 7, 1975

[21] Appl. No.: 556,376

[52] U.S. Cl. ..... 112/214
[51] Int. Cl.[2] ..... D05B 12/14; D05B 27/10
[58] Field of Search ..... 112/203, 210, 212, 214, 112/204, 215

[56] References Cited

UNITED STATES PATENTS

| | | | |
|---|---|---|---|
| 2,678,010 | 5/1954 | Pinkvoss | 112/214 |
| 3,656,442 | 4/1972 | Hennig et al. | 112/214 |
| 3,726,240 | 4/1973 | Emich | 112/214 X |

*Primary Examiner*—G. V. Larkin
*Attorney, Agent, or Firm*—Blum Moscovitz Friedman & Kaplan

[57] ABSTRACT

A sheet-material feeding unit adapted to be used with a machine, such as a sewing machine, where sheet material is fed past a work station where operations are performed on the sheet material. A supporting structure which is capable of being attached to a part of the machine supports rotary gears having external teeth meshing with internal teeth of a belt which has an external friction surface for engaging the sheet material so as to feed the latter past the work station. This construction prevents slippage between the gears and belt.

11 Claims, 8 Drawing Figures

SHEET-MATERIAL FEEDING UNIT

BACKGROUND OF THE INVENTION

The present invention relates to structures capable of feeding sheet material while operations are performed thereon.

The invention relates in particular to a unit which is capable of being attached to an existing machine for feeding sheet material past a work station of the machine where operations are performed on the sheet material.

It is of course recognized that a sheet material must be fed properly with respect to a work station where operations are performed on the sheet material. For example, in the case of a sewing machine, the sheet material which is worked on must be fed properly with respect to the needle which reciprocates through the sheet material to form stitches.

However, in situations of this latter type, proper feeding of sheet material is not assured at the present time. This is particularly true of multiple layer sheet material. For example in a sewing machine it is common practice to attach by a row of stitches an upper layer of sheet material to a lower layer of sheet material. Generally there is no problem in connection with the feeding of the lower layer of sheet material inasmuch as the latter is directly engaged by the feed dogs of the sewing machine. However, the upper layer of sheet material which is to be attached by stitches, for example, to the lower layer of sheet material is not engaged by the feed dogs and thus can easily slip with respect to the lower layer of sheet material resulting in undesirable gathers forming either on the upper or the lower layer of sheet material. Conventionally, reliance is only made on the pressure of the upper layer against the lower layer by way of the force with which the presser foot urges the upper layer against the lower layer. However, such pressure is not adequate in most cases to maintain the two layers of sheet material stationary with respect to each other while they are stitched together.

These problems have been recognized, and attempts have been made to solve them. However, up to the present time a satisfactory solution to the above problems has not been achieved. For example, it has been proposed to apply a rotary feed roller to the upper layer of sheet material so as to feed the latter together with the lower layer, but because of unavoidable slippage in the drive which rotates such a feed roller, there is still for the upper layer a different degree of feed than for the lower layer, so that the above problems have not been adequately solved up to the present time.

SUMMARY OF THE INVENTION

It is accordingly a primary object of the present invention to provide a construction which will avoid the above drawbacks.

In particular, it is an object of the present invention to provide a structure which is capable of operating without slip to feed sheet material such as an upper layer of sheet material which engages a lower layer of sheet material during sewing of these layers to each other.

It is especially an object of the present invention to provide a structure of the above type in the form of a separate unit which may be purchased separately and conveniently attached to a conventional machine.

Moreover, it is an object of the present invention to provide a unit of this type which can be readily connected to the machine so as to utilize the drive of the machine itself for the purpose of feeding the sheet material at the proper rate.

In addition, it is an object of the present invention to provide a unit of the above type which has a convenient adjustment for the pressure with which a friction surface of a feed element engages the sheet material which is fed by the feed element.

Furthermore, it is an object of the present invention to provide a construction according to which starting and stopping of the feed of the sheet material can be carried out very conveniently.

In fact, it is an object of the present invention to provide a construction where the stopping and starting of the feeding of the sheet material provided by the unit of the invention can be carried out, without any attention on the part of the operator, in synchronism with the stopping and starting of the feeding of sheet material by the machine itself.

In addition, it is an object of the present invention to provide a unit of the above type which while capable of achieving the desired results also operates in such a way that it does not in any way interfere with the conventional operations of a machine and thus does not create any inconvenience for the operator of the machine.

Furthermore, it is an object of the present invention to provide a unit of the above type which is composed of relatively simple rugged components which assure achievement of the desired results in a highly reliable manner while at the same time being of a simple robust nature making it possible to provide the unit of the invention at a relatively low cost and with minimum maintenance.

According to the invention the feed unit, which is adapted to be used with a machine, such as a sewing machine, where a sheet material is fed past a work station where operations are performed on the sheet material, includes a support means and an attaching means which is operatively connected with the support means for attaching the latter to a part of the machine. A rotary drive gear means is supported for rotary movement by the support means and has external teeth. An endless belt means has internal teeth meshing with the external teeth of the drive gear means so as to be driven without slip thereby. This belt means has an external friction surface for engaging sheet material and feeding the latter past a work station.

BRIEF DESCRIPTION OF DRAWINGS

The invention is illustrated by way of example in the accompanying drawings which form part of this application and in which:

FIG. 4 is a side elevation of the unit of the invention shown attached to a sewing machine with FIG. 4 showing the unit of the invention in an inoperative position where it is raised away from the work while FIG. 2 shows the structure of the invention engaging and feeding the work;

FIG. 5 is a fragmentary partly sectional schematic illustration of how the structure of the invention operates;

FIG. 6 diagrammatically represents how the upper and lower layers of sheet material of FIG. 5 are fed;

FIG. 7 is a partly sectional fragmentary schematic illustration of the problem which is solved by the present invention; and FIG. 8 is a diagrammatic representation of how the sheet material layers are conventionally fed with a structure as shown in FIG. 7.

DESCRIPTION OF PREFERRED EMBODIMENTS

Although the principles of the present invention and the specific structure thereof are suitable for many different types of machines where sheet material is fed, the invention is described below in connection with a sewing machine both for purposes of illustration and because the present invention is of particular utility in connection with a sewing machine.

Figures 4, 5, 6, 7, 8:
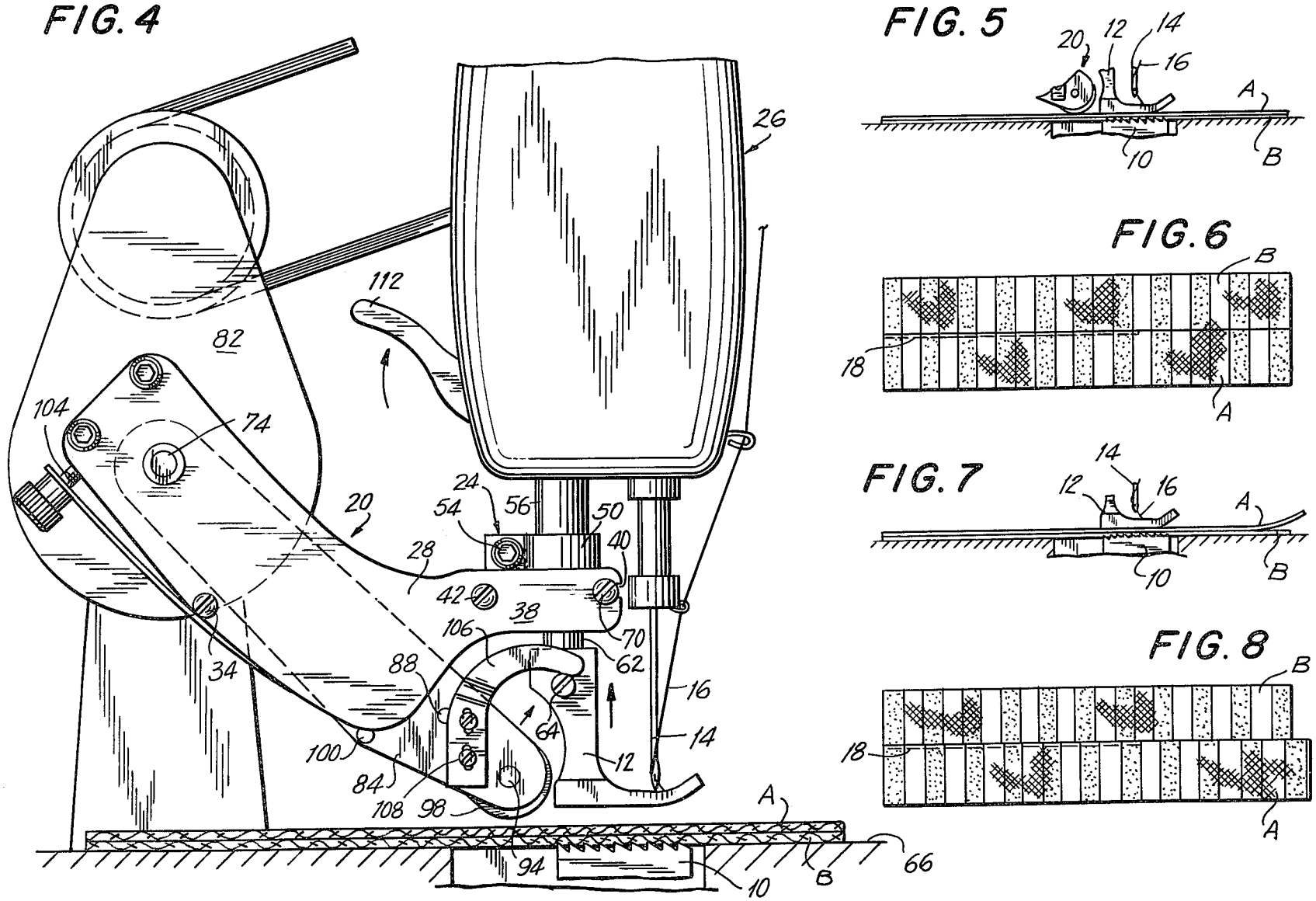

The problems solved by the present invention are illustrated in FIGS. 7 and 8. Thus, FIG. 7 illustrates an upper layer A of a sheet material such as a fabric and a lower layer B of a sheet material such as a suitable fabric. These layers A and B are illustrated in FIG. 7 as being sewn to each other by way of stitches in a conventional sewing machine. As is schematically illustrated in FIG. 7, the lower layer B is fed by the operation of conventional feed dogs 10, while the upper layer A is pressed against the lower layer B by a presser foot 12. FIG. 7 also schematically illustrates the lower end of a needle 14 which acts in a known way to sew the layers A and B to each other with stitches formed in part by the thread 16.

Because the lower layer B of the sheet material is directly fed by the feed dogs 10 while the upper layer A is fed solely by frictional engagement with the layer B and the presser foot 12 with the latter pressing downwardly as is conventional, there is an unavoidable slippage between the fabric layers A and B. The result of this slippage is illustrated in FIG. 8 where the shaded rectangles extending across the strips of sheet material A and B are intended to represent any pattern. These shaded rectangles should be in line with each other. However, because of the unavoidable slippage the upper layer A is not fed at the same rate as the lower layer B, and thus the lower layer B moves forwardly at a slightly greater rate than the upper layer A, resulting in the inaccuracy in the attachment of the layers to each other which is illustrated in FIG. 8.

Referring now to FIG. 5, it will be seen that there has been added to the structure of FIG. 7 a unit 20 of the present invention, this unit 20 being fragmentarily illustrated in FIG. 5. As a result of the presence of this unit 20 which is described in greater detail below, the layers A and B will be fed in the manner shown in FIGS. 5 and 6. Thus, referring to FIG. 6 it will be seen that the layers A and B are precisely maintained in longitudinal alignment without any relative longitudinal movement therebetween, so that a precise sewing of the layers to each other is achieved by way of the structure 20 of the present invention.

In the case of FIGS. 6 and 7, the layers A and B may be considered as being sewn to each other by a line of stitches 18 extending along an edge region of the layers A and B. Thereafter these layers are unfolded and spread apart while still connected by the line of stitches 18 so as to form the connected layers shown in FIGS. 6 and 8. Of course in the case of FIG. 8 although at the start of the stitching shown at the left of FIG. 8 there was precise longitudinal alignment between the layers A and B, this longitudinal alignment was not maintained with the degree of non-alignment gradually increasing toward the right as illustrated in FIG. 8. On the other hand, in FIG. 6 by way of the structure 20 of the present invention it has been possible to maintain the longitudinal alignment as illustrated.

Referring now to FIGS. 1–4, the details of the unit 20 of the present invention are illustrated therein. Thus, the unit 20 of the invention includes a support means 22 which is attached by way of an attaching means 24 to a stationary part of the machine 26.

Figure 2:
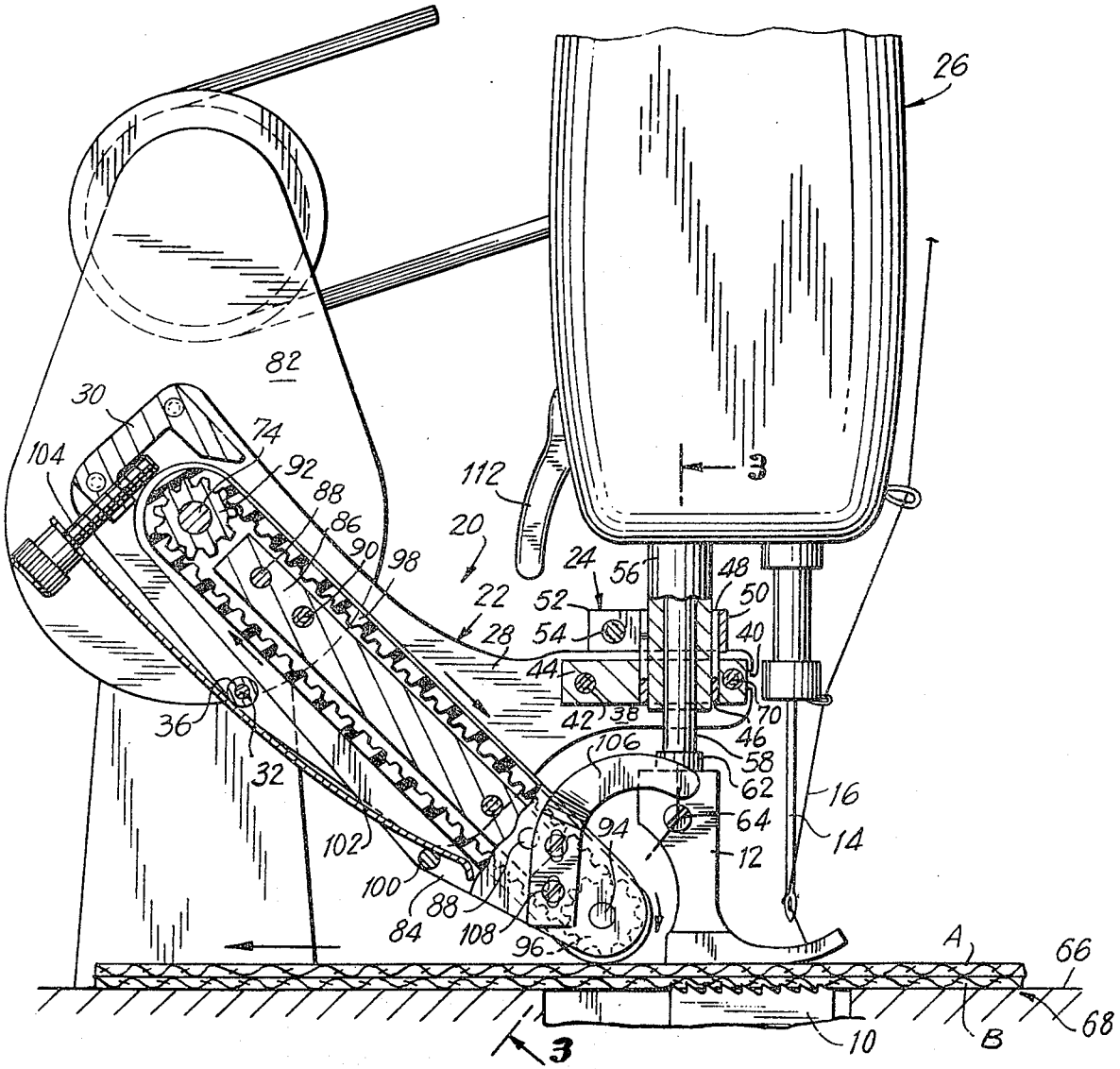
FIG. 2 is a partly sectional side elevation of the structure of FIG. 1 taken along line 2—2 of FIG. 1 in the direction of the arrows.

The support means 22 includes a pair of flat parallel outer side walls 28 made of any suitable rigid metal or plastic. These outer side walls 28 are spaced from each other by a transverse end member 30 of substantially C-shaped cross section, as shown in FIG. 2. Thus, the side walls 28 may be bolted at their upper left ends, as viewed in FIGS. 2 and 4, to the member 30. In addition, the pair of parallel side walls 28 of the stationary frame of the support means 22 are fixed to each other by way of a transversely extending pin 32 having at its ends threaded bores which receive the shanks of a pair of screws 34 which extend through suitable openings in the side walls 28. One of the screws 34 is shown in FIG. 4 while the pin 32 is shown in section in FIG. 2. Between the side walls 28 the pin 32 supports for free rotary movement a sleeve 36, for a purpose referred to below.

The pair of parallel flat substantially rigid side walls 28 are of a generally rectangular configuration except for upper forward extensions 38 of these side walls. The extensions 38 are formed at their front edges with notches 40, and rearwardly of these notches the extensions 38 are formed with a pair of aligned openings for receiving the shank of a screw 42. The head of the screw 42 is visible in FIG. 4 while a nut which is fastened on the threaded end of the screw is situated at that side of the wall 28 of FIG. 2 which is not visible in FIG. 2.

The extensions 38 serve to releasably fasten the stationary frame, which includes the walls 28, to the attaching means 24. The attaching means 24 includes a lower rigid block 44 made of any suitable metal or plastic and situated between and in engagement with the inner surfaces of the walls 28. The block 44 of the attaching means 24 is formed with an opening passing therethrough and fixedly connected to the block 44 in this opening is a vertically extending sleeve 46 which is formed with a mumber of slits extending downwardly from the top end of the sleeve 46 so as to form the latter with a plurality of springy tongues 48. These tongues 48 are surrounded by a clamp 50 having a pair of parallel free ends 52 spaced from each other and capable of being drawn together by a bolt-and-nut assembly 54, the head end of which is visible in FIG. 4.

Figure 1:
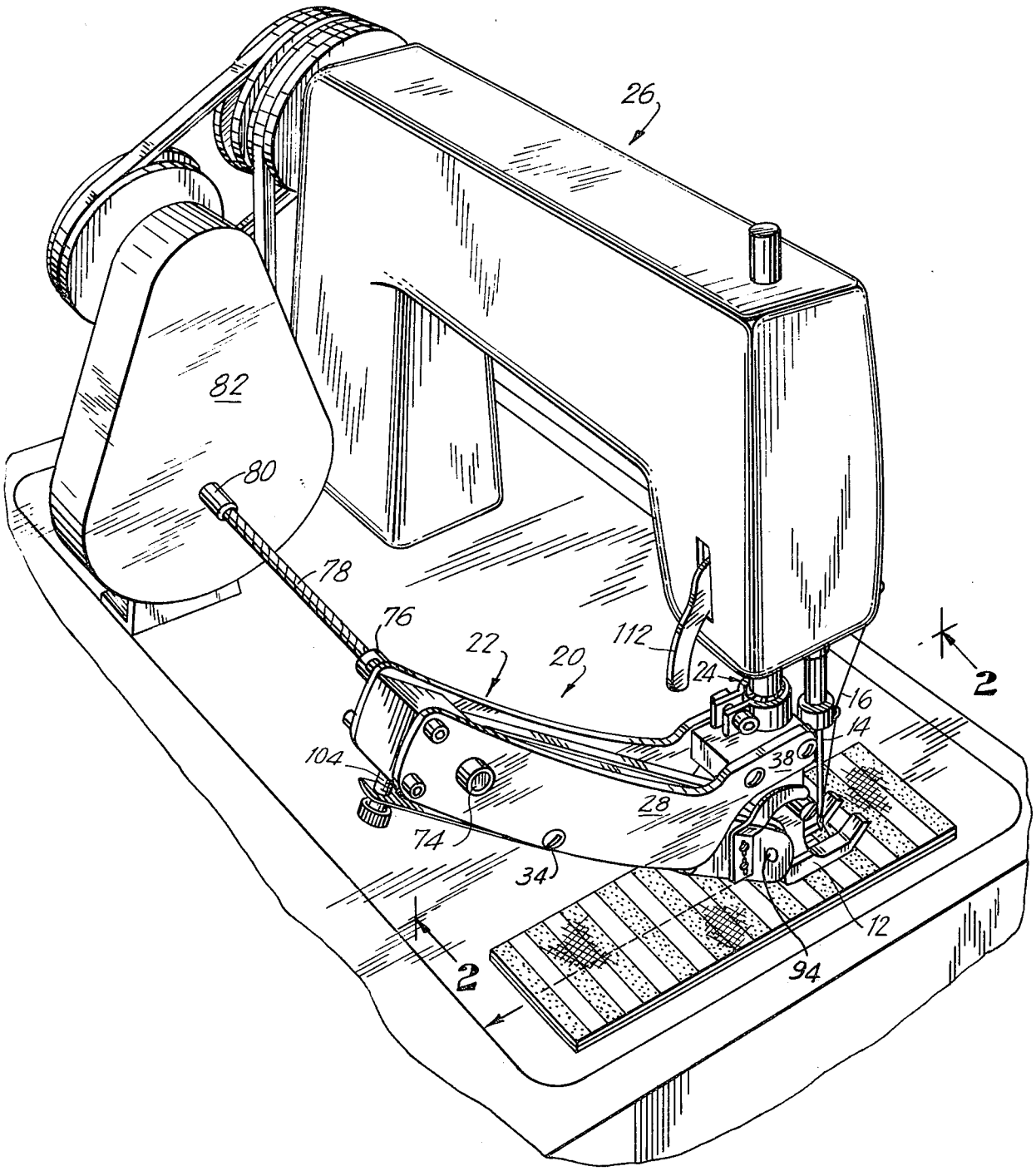
FIG. 1 is a perspective illustration of a sewing machine provided with the unit of the invention, this construction being shown in FIG. 1 as seen when looking downwardly from the rear of the sewing machine onto the unit of the invention.
Figure 3:
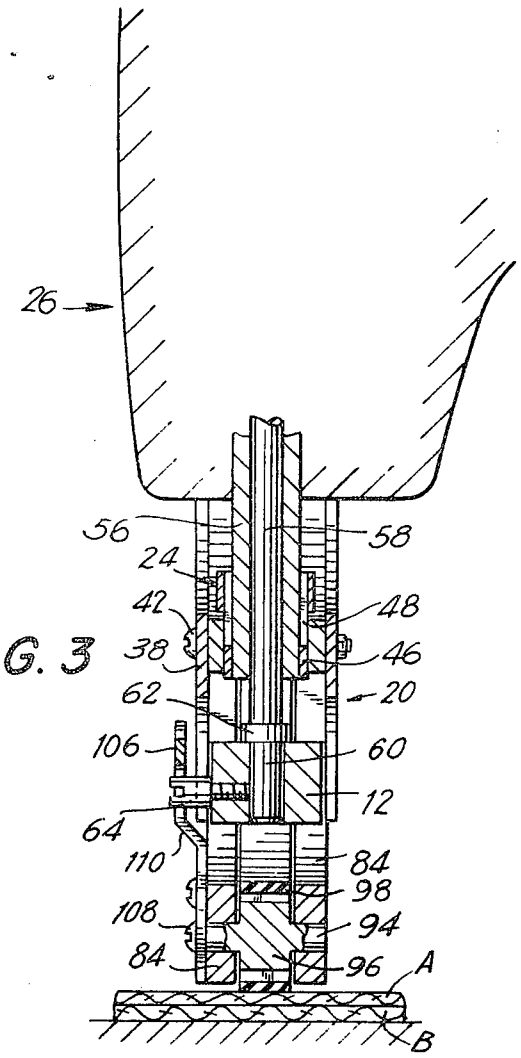
FIG. 3 is a transverse section of the structure of FIG. 2 taken along line 3—3 of FIG. 2 in the direction of the arrows.

In the illustrated example, while the clamp 50 is in a loose condition, the sleeve 46 is slipped onto a stationary sleeve 56 of the illustrated sewing machine. This sleeve 56 serves to guide for vertical movement a post 58 which carries the presser foot 12. The presser foot 12 is conventional. It is formed with a bore for receiving the lower elongated portion 60 of the post 58, as indicated in FIG. 3. This lower portion 60 of the post 58 extends downwardly from a collar or flange 62 of the post 58. It will be noted that this flange 62 limits the extent to which the presser foot 12 can be moved upwardly along the post 58 while at the same time the collar 62 is of a smaller diameter than the interior of the sleeve 46. Thus, with the attaching means 24 separated from the support means 22 and with the presser foot 12 removed from the post 58, the sleeve 46 can easily be slipped onto the stationary sleeve 56 of the sewing machine. The presser foot 12 is easily removed by removing the set screw 64 shown in FIGS. 2 and 3. Once the sleeve 46 together with the block 44 and clamp 50 are placed on the sleeve 56, the presser foot 12 can be returned and fixed in position by way of the set screw 64. It is to be noted, however, that the set screw 64 is not a conventional set screw. The conventional set screw of the sewing machine is removed and replaced by the illustrated set screw 64 which has extending to the left from the presser foot 12, as illustrated in FIG. 3, an elongated portion which is longer than the corresponding part of a conventional set screw. This longer set screw 64 forms part of the structure of the present invention and serves a function pointed out below.

When the attaching means 24 is thus situated on the sleeve 56, the bottom surface of the block 44 is situated at a predetermined distance from the surface 66 of the table 68 on which the sheet material is placed, and when the elevation of the attaching means 24 is thus determined the clamp 50 is tightened so as to fix the attaching means on the sleeve 56 in this manner.

The screw 42 which passes through the rear opening of the block 44 has been removed therefrom and from the aligned opening in the parallel walls 28 of the stationary frame part of the support means 22, so that the screw 42 is not assembled with the block 44 at this time. However the block 44 has a forward horizontal bore which receives the shank of a screw 70 the head end of which is visible in FIG. 4. The opposite threaded end carries a nut situated at the side of wall 28 which is not visible in FIG. 2. This screw 70 remains in the block 44, and with the attaching means 24 thus fixed to the stationary part 56 of the machine 26 the walls 28 are slipped at their inner surfaces along the opposed side surfaces of the block 44 with the screw 70 being received in the notches 40 while the walls 28 become situated between the block 44 and the head of screw 70 as well as the nut carried thereby, respectively. Now the walls 28 are swung around the screw 70 until the openings of the wall 28 which are to receive the screw 42 are aligned with the rear bore of the block 44, and then the screw 42 is slipped through the opening in the wall 28 visible in FIG. 4 and then through the rear bore of the block 44 to pass finally through the opening of the wall 28 shown in FIG. 2, and the nut 72 which is visible in FIG. 3 is then tightened onto the screw 42 while the nut carried by the screw 70 is also tightened onto the latter so that in this way the support means 22 is fixed to the attaching means which in turn has been fixed to the sleeve 56 as described above.

The upper rear portions of the walls 28 are respectively formed with aligned openings which carry bearings which support for rotation a shaft 74 which has a non-circular free end portion projecting beyond the wall 28 which is visible in FIG. 2 at the side of the wall 28 which is not visible in FIG. 2. This non-circular free end portion of the shaft 74 extends into a mating non-circular bore of a sleeve 76 which is fixed to the shaft 74, this sleeve 76 being visible in FIG. 1. The sleeve 76 in turn is fixed to a flexible shaft 78 which carries distant from the sleeve 76 a second sleeve 80 which is connected with a rotary driven member of the drive mechanism situated within the housing portion 82 of the machine 26. Thus, through this flexible drive shaft 78 the shaft 74 is driven directly from the drive of the machine 26.

The support means 22 includes not only the stationary frame formed by the wall 28 but also a swingable frame which includes a pair of parallel flat walls 84 made of any suitable metal or plastic and situated between and next to the walls 28. One of these walls 84 is visible in FIG. 2 while a part of the other wall 84 is visible in FIG. 4. Both of these walls 84 are also visible in FIG. 3. Thus, the outer surfaces of the inner walls 84 slidably engage the inner surfaces of the outer walls 28 of the support means 22. These walls 84 which form the inner swingable frame of the support means 22 are respectively formed with aligned openings through which the shaft 74 extends, so that the shaft 74 serves to support the inner swingable frame of the support means for swinging movement about the axis of the shaft 74. These walls 84 extend forwardly and downwardly beyond the walls 28 in the manner apparent from FIG. 4.

The walls 84 of the inner swingable frame of the support means 22 are fixed to each other by way of an intermediate block 86 which is situated between and engages the inner surface of the walls 84, this intermediate block 86 being shown in section in FIG. 2. The block 86 carries a pair of outer dowels 88 received in openings of the walls 84 so as to position these walls properly with respect to the block 86. In addition, suitable set screws 90 extend through openings of the walls 84, engaging shoulders in these openings and being threaded into threaded bores of the block 86 for fixing the latter to the walls 84. These set screws 90 do not extend outwardly beyond the exterior surfaces of the inner walls 84.

The shaft 74 is fixed with a rotary gear 92 so that this gear is driven in rotation when the shaft 74 is rotated by the drive shaft 78. The lower free end portions of the walls 84 are respectively formed with aligned openings receiving the ends of a shaft 94 which is thus supported for free rotation by the walls 84. This shaft 94 carries between the walls 84 a second rotary gear 96 identical with the gear 92. Thus, the gears 92 and 96 form a rotary drive gear means.

The teeth of the identical gears 92 and 96 mesh with the internal teeth of a belt means 98 in the form of an endless flexible belt having the internal teeth shown in FIG. 2. Because these internal teeth of the belt means 98 mesh with the teeth of the rotary drive gear means 92, 96, there will be no slip between the gears and the belt. It will be noted from FIG. 2 that the exterior periphery of the gear 96 coincides with the exterior peripheral lower end surfaces of the walls 84. Thus the belt 98 will project beyond the lower forward peripheral edge regions of the walls 84. The belt means 98 is made of a material such as rubber or the like which has an exterior surface of a high coefficient of friction, and this exterior friction surface of the belt 98 is adapted to engage the upper surface of the upper layer A of the sheet material layers which are worked on. Of course the lower layer B is situated between the layer A and the surface 66 of the table 68 as shown in FIG. 2, so that the lower layer B of the sheet material is directly fed by the dogs 10 as described above.

As is apparent from the above description, when a drive is transmitted from the flexible drive shaft 78 through the shaft 74 to the gear 92, the latter will rotate and drive the belt means 98 which in turn will rotate the gear 96, and at the same time the exterior friction surface of the belt will directly engage the layer of sheet material A so as to feed the latter toward the left, as viewed in FIG. 2. The gears 92 and 96 rotate in a clockwise direction, as viewed in FIG. 2, so that the feed of the layer A will be toward the left as shown by the arrow at the lower left of FIG. 2.

An urging means is provided for urging the exterior friction surface of the belt means against the upper surface of the layer of sheet material A. For this purpose the walls 84 fixedly carry a pin 100 which extends between these walls 84. A leaf spring 102 extends over and presses against the pin 100. This leaf spring 102 extends beneath and engages the rotary sleeve 36 which is carried by the pin 32 as described above. At its rear end region the leaf spring 102 is formed with an opening or notch which receives the shank of an ajusting screw 104 which forms an adjusting means for adjusting the force with which the urging means presses the exterior friction surface of the belt means against the sheet material A. For this purpose the adjusting screw 104 extends through an opening or notch in the rear end region of the leaf spring 102 and into a threaded bore formed in the element 30, as shown in FIG. 2. The lower head end of the screw 104 is suitably knurled, so that the operator can easily turn the screw 104 for adjusting the force with which the spring 102 acts to urge the belt against the sheet material A.

It is to be noted that when the unit 20 of the invention is separate from the machine 26, the leaf spring 102 will urge the swingable frame which includes the walls 84 against the sleeve 36. However, when the attaching means 24 is attached to the stationary part 56 of the machine 26, the height of the block 44 from the surface 66 is chosen so that during operation the lower edges of the walls 84 will be spaced above the sleeve 36, so that at this time the force of the spring 102 will act to urge the exterior friction surface of the belt means against the upper surface of the layer A.

As was indicated above, the set screw 64 is made longer than a conventional set screw for the purposes of a further feature of the present invention. According to this latter feature a lifting means is provided for lifting the friction surface at the exterior of the belt 98 away from the sheet material A so as to terminate the feeding thereof.

This lifting means includes not only the set screw 64 but also a lifting arm 106 which is fixed by screws 108 to the left wall 84, as viewed in FIG. 3. As is apparent from FIG. 3 the lifting arm 106 has an angled portion 110 displacing the upper C-shaped portion of the arm 106 to the left away from the left wall 84 in the manner shown in FIG. 3. This curved free end portion of the arm 106 extends over the projecting portion of the set screw 64 in the manner most clearly apparent from FIGS. 2 and 3. During operation of the unit of the invention, when it is in the position shown in FIG. 2, the set screw 64 is situated beneath and spaced slightly from the arm 106. As is well known the presser foot 12 is raised when the operator turns the lever 112 upwardly from the position of FIG. 2 into the position of FIG. 4. This upward swinging of the lever 112 will raise the presser foot 12 so that the set screw 64 will engage the arm 106 and thus swing the walls 84 in a counterclockwise direction around the shaft 74, as viewed in FIGS. 2 and 4, so that in this way the exterior friction surface of the belt 98 is displaced away from the layer A, and thus the feeding thereof by the belt is terminated simultaneously with lifting of the presser foot.

It is to be noted that the entire unit of the present invention is situated to the rear of and above the presser foot 12 so that the unit of the invention does not in any way interfere with the operations carried out by the operator of the machine. The same it true of the flexible drive shaft 78 which is situated to the rear part of the machine and at a location where it will not in any way interfere with the manipulations of the operator. Moreover, once the unit 20 of the invention is attached to the machine the operator need pay no particular attention to the unit 20. It will stop and start with the drive of the machine as a result of the connection of the drive shaft 78 to the machine drive itself. The transmission ratio between the drive shaft 78 and the rotary drive gear means 92, 96 and the belt means 98 is such that the linear speed of feed of the upper layer A will equal the linear speed of feed of the lower layer B provided by way of the feed dogs 10. Furthermore, the engagement between the belt and the layer A will take place simultaneously with the engagement of the layer A by the presser foot 12 as a result of the lifting means 64, 106 of the present invention as described above. This latter stopping and starting of the feed by lifting and lowering the belt simultaneously with the lifting and lowering of the presser foot 12 also contributes to the automatic operation of the unit of the invention in a perfectly accurate and entirely proper manner without requiring any attention on the part of the operator.

Because the belt 98 is driven without slip by way of the gear 92 which rotates at a given speed directly from the drive of the machine itself, the belt will move at a predetermined rate which will not vary, and thus the layer A will be accurately fed, achieving in this way the results described above in connection with FIGS. 5 and 6.

What is claimed is:

1. In a feed unit which is adapted to be used with a machine, such as a sewing machine, where a sheet material is fed past a work station where operations are performed on the sheet material, support means, attaching means operatively connected with said support means for attaching said support means to a part of the machine, rotary drive gear means supported for rotary movement by said support means and having external teeth, and endless belt means having internal teeth meshing with said external teeth of said drive gear means to be driven without slip thereby, said belt means having an external friction surface for engaging sheet material and feeding the latter past a work station.

2. The combination of claim 1 and wherein said drive gear means includes a pair of rotary gears respectively having external teeth which mesh with said internal teeth of said belt means, and urging means cooperating with one of said gears for urging the latter toward the sheet material for pressing the external friction surface of said belt means against the sheet material during feeding thereof.

3. The combination of claim 2 and wherein an adjusting means is operatively connected with said urging means for adjusting the force with which said one gear is urged toward the sheet material.

4. The combination of claim 2 and wherein said support means includes a stationary frame operatively connected with said attaching means and remaining stationary at least when said attaching means attaches said support means to said part of the machine, and a swingable frame swingably carried by said stationary frame and forming not only part of said support means but also part of said urging means, said swingable frame supporting at least said one gear for rotary movement, and said urging means including a spring acting on said swingable frame for urging said one gear toward the sheet material.

5. The combination of claim 4 and wherein said stationary frame of said support means supports for rotary movement a shaft which is fixed to the other of said gears, and said swingable frame being supported for swinging movement by said rotary shaft.

6. The combination of claim 5 and wherein a transmission means is operatively connected with said shaft for transmitting rotary movement thereto for driving said other gear by rotation of said shaft and thus driving said belt means with the latter rotating said one gear which is carried by said swingable frame.

7. The combination of claim 6 and wherein said transmission means includes a flexible drive shaft operatively connected with said shaft which is fixed to said other gear and which is adpated to be connected with a drive of the machine to be rotated thereby, said flexible drive shaft being situated beyond and out of the way of said work station so as not to interfere with operations which are carried out at the work station.

8. The combination of claim 5 and wherein a lifting means is operatively connected with said swingable frame for lifting the part thereof which carries said one gear away from the sheet material to displace the friction surface of said timing belt means away from the sheet material to terminate the feeding thereof by said belt means.

9. The combination of claim 8 and wherein said lifting means includes an arm fixed to and projecting from said swingable frame, and the combination further including an elongated projection adapted to be carried by an element of the machine which moves up and down between upper and lower positions, said projection extending beneath said arm to be situated below the same when the machine element is in said lower position thereof and when the external friction surface of said belt means presses against sheet material to feed the latter, while said projection is close enough to said arm for engaging and lifting the latter when the machine element moves upwardly from said lower to said upper position thereof.

10. The combination of claim 9 and wherein said swingable frame carries a pin, said urging means including the latter pin and a leaf spring pressing on said pin, and screw means threadedly connected with said stationary frame of said support means and engaging said leaf spring for adjusting the force with which the latter acts on said pin to urge said one gear and said friction surface of said belt means against the sheet material.

11. The combination of claim 10 and wherein said stationary frame includes a pair of outer parallel walls while said swingable frame includes a pair of inner parallel walls situated between and next to said outer walls, said gears being situated together with said belt means between said inner walls of said swingable frame, and the latter having a lower portion projecting downwardly beyond said stationary frame and carrying said one gear, at least a part of said belt means which extends around said one gear projecting downwardly beyond said inner walls of said swingable frame for engaging sheet material with said friction surface without interference from said swingable frame.

* * * * *